United States Patent [19]

Crawford et al.

[11] Patent Number: 5,038,435

[45] Date of Patent: Aug. 13, 1991

[54] ANCHOR SET TOOL

[75] Inventors: Dan E. Crawford; Douglas A. Rogge, both of Charles City, Iowa

[73] Assignee: Diversified Fastening Systems, Inc., Charles City, Iowa

[21] Appl. No.: 624,971

[22] Filed: Dec. 10, 1990

[51] Int. Cl.[5] ..... B25F 3/00

[52] U.S. Cl. ..... 7/165; 408/238; 279/93; 7/158

[58] Field of Search ..... 7/158, 165; 408/119, 408/118, 238, 239 PV, 714; 279/83, 89, 93

[56] References Cited

U.S. PATENT DOCUMENTS

| | | | |
|---|---|---|---|
| 931,327 | 8/1909 | Manzel | 279/93 |
| 1,516,099 | 11/1924 | Hill | 7/165 X |
| 1,841,635 | 1/1932 | Salmon | 279/93 X |
| 2,337,402 | 12/1943 | Mills | 279/83 |
| 3,336,611 | 8/1967 | Schepp | 7/158 |
| 3,965,510 | 6/1976 | Ernst | 7/158 |
| 4,092,753 | 6/1978 | Fuhrmann | 7/165 X |
| 4,791,690 | 12/1988 | Kuang-Wu | 7/158 X |
| 4,954,025 | 9/1990 | Crawford et al. | 408/238 |

*Primary Examiner*—Larry I. Schwartz
*Assistant Examiner*—Robert Schultz
*Attorney, Agent, or Firm*—G. Brian Pingel

[57] ABSTRACT

A tool adapted for use with a drill for installing screw anchors in concrete or masonry walls or the like having a sleeve type body, a bit holder slidably located in the body, a drill bit with a handle secured in the bit holder, a coil spring seated on a collar of the bit holder and extending around the bit, a nut driver secured to the front end of the body, a set screw to retain the drill bit in the bit holder and also to serve as a means to advance and retract the drill bit, and a cutout comprised of a longitudinal slot, a retainer notch and at least one depth notch. The longitudinal slot is adjoined by both the retainer notch and the depth notch through the use of curved sidewalls which allow the tool operator to use a smooth, uniform, and efficient motion to adjust extension of the drill bit.

4 Claims, 2 Drawing Sheets

40
18
23
26
25
27
45
46
22
48
44
28
60
38
30
34
61
63
62
64
32
67
68
39
36
12
66
65
16
14
20
42
41
54
56
52
24
58
59

ANCHOR SET TOOL

BACKGROUND OF THE INVENTION

1. Field of the Invention

The present invention relates in general to a tool adapted for use with a hand drill for installing screw anchors in concrete or masonry walls and more specifically relates to such tools that have components designed to improve drill bit adjustment Which result in increasing the efficiency of tool operation.

2. Description of the Prior Art

Anchor set tools having a general configuration similar to that of the present invention are known in the art as described in U.S. Pat. No. 4,954,025 issued to Crawford et al. Sept. 4, 1990. The general composition of such known anchor set tools includes a sleeve type body in which a drill bit is retractably received, and when retracted, a driver bit located at one end of the body. The bit holder is slidably located in the bore of the sleeve type body for receiving a handle of the drill bit. A set screw extends from one side of the bit holder through a slot in the body so that the drill bit can be positioned with respect to the body.

Although anchor set tools of the above general configuration have proved usual and efficient in comparison to prior methods of setting anchors, such prior devices have suffered from a deficiency that affects their operational function. In prior devices, the cutout is designed utilizing square angles that make the adjustment of the drill bit extension cumbersome and awkward, and therefore, operation of the anchor set tool is inefficient. The present invention, which eliminates the square angles, allows for a much smoother and efficient drill bit adjustment. The present invention is an improvement over the above described devices and eliminates the foregoing described deficiencies.

SUMMARY OF THE INVENTION

The present invention provides an improved tool adapted for use with a hand drill for installing screw anchors in concrete or masonry walls or the like. The invention includes a sleeve type body, a bit holder slidably located in the bore of the body, a drill bit secured in the bit holder, a set screw, a driver attachm®nt secured to the front end of the body, and a coil spring through which said bit extends to serve as a biasing means for urging the bit in a rearward direction in the body bore. The body includes a cutout comprised of a longitudinally aligned open slot that is associated with a retainer notch and at least one depth notch. The longitudinal slot is adjoined by the retainer notch and the depth notches through the use of rounded sidewalls that provide for smooth and efficient drill bit adjustment.

The bit holder has a set screw extending from one side of the holder through the slot in the body to serve as a guide for manually moving the bit with respect to the body and as a means for retaining the bit in the bit holder. The bit holder is formed with a cavity for receiving the smooth end of the drill bit with the cavity wall closely encircling the smooth end to prevent the bit from wobbling with respect to the holder.

The driver attachment has a head portion with a hex drive socket and a neck portion that is positioned in the bore of the front section of said body. A passage way extends from the bottom of the head.portion and through the neck portion to open to said body bore and closely encircles the bit to serve as a bit guide means. A preferred embodiment of the invention is described below in connection with the accompanying drawings wherein:

DETAILED DESCRIPTION OF THE PREFERRED EMBODIMENT

Figure 1:
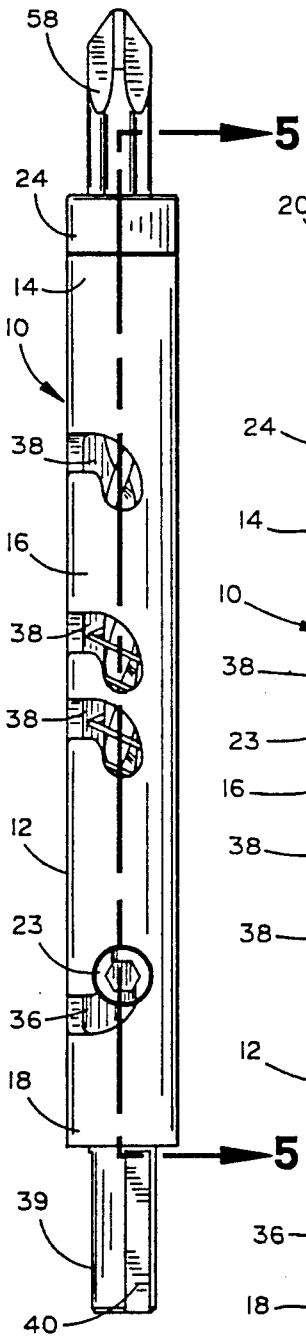
FIG. 1 is a side view in elevation of a preferred embodiment of an improved anchor set tool of the present invention that includes a sleeve type body for housing a retractable drill bit.
Figures 3, 6, 7:
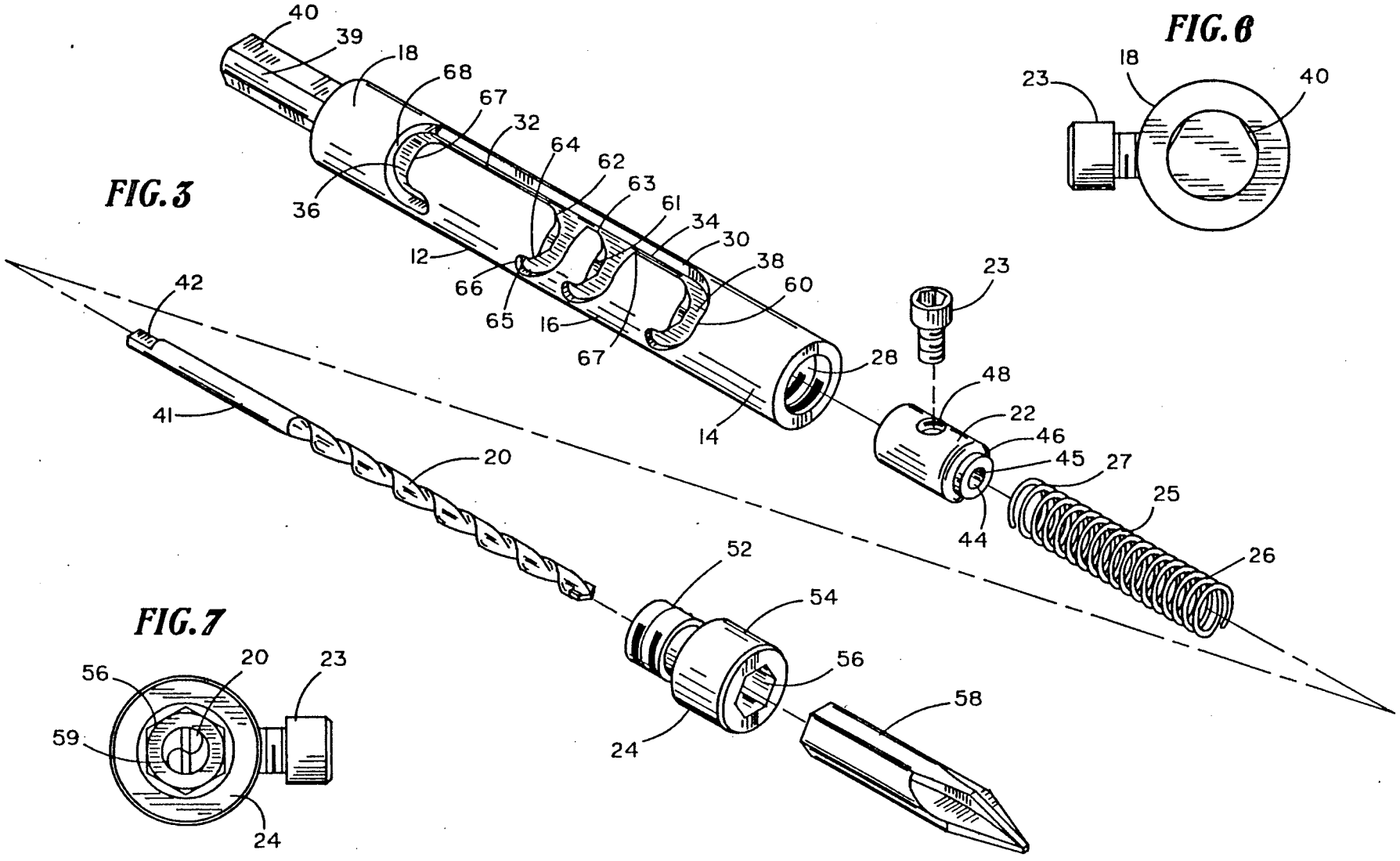
FIG. 3 is an exploded perspective view of the embodiment of FIG. 1 shown together with a river bit that can be utilized with the present invention.
FIG. 6 is a bottom view of the embodiment of FIG. 1.
FIG. 7 is a top view of the embodiment of FIG. 1.

With reference to the drawings, the anchor set tool of this invention is indicated generally as 10 in FIG. 1, and includes a cylindrical, sleeve type, body 12, with a front section 14, a middle section 16, and a rear section 18. As indicated in FIG. 3, a drill bit 20 is secured to a bit holder 22 through the use of a set screw 23. The bit holder 22 is slidably located in the body 12. A driver attachment 24 is secured to the front section 14 of the body 12. A coil spring 25, with both a front end 26 and a rear end 27, serves as a biasing means to urge the bit holder 22 and the drill bit 20 rearwardly in the body 12.

Figure 2:
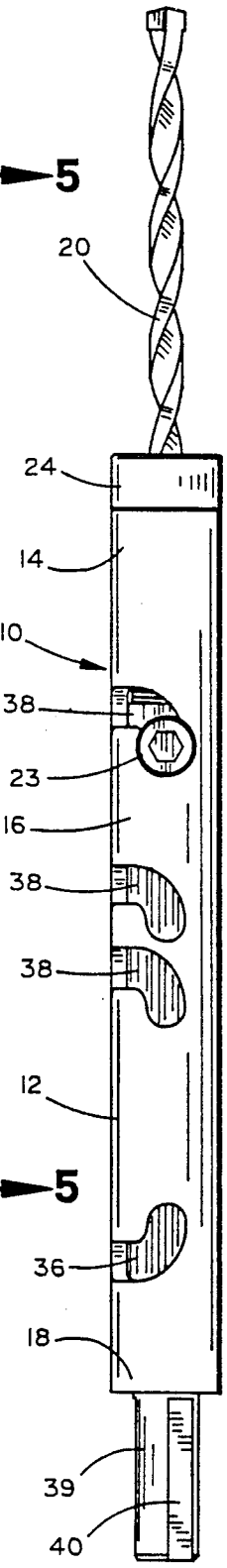
FIG. 2 is a view similar to that of FIG. 1 but with the drill bit of the preferred embodiment shown in an extended position.
Figure 4:
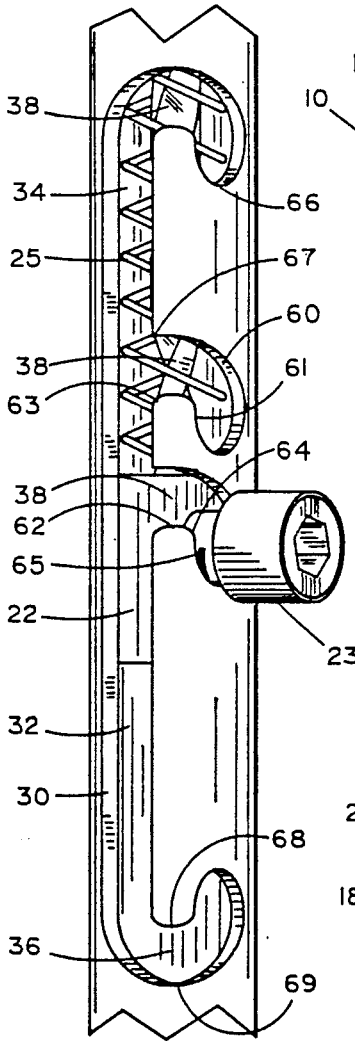
FIG. 4 is an enlarged fragmentary side view of the embodiment of FIG. 1 with the tool rotated counterclockwise forty-five degrees from the showing of FIG. 1.
Figure 5:
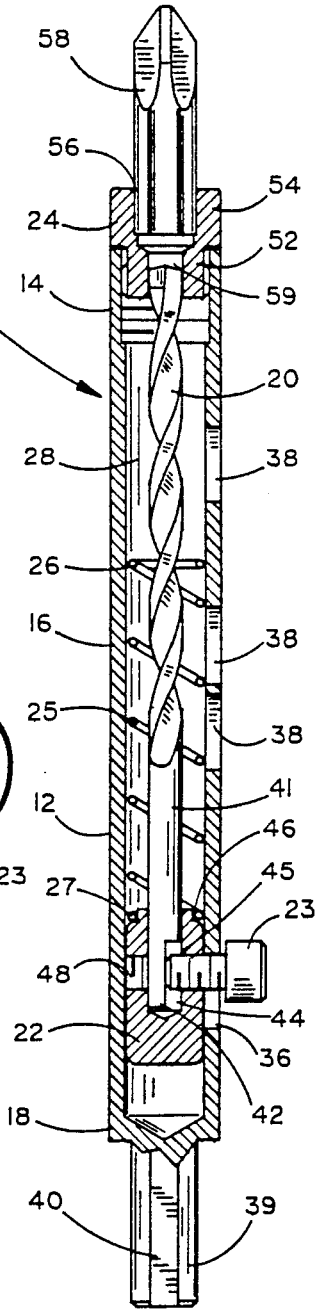
FIG. 5 is a cross-sectional view taken along the line 5—5 of FIG. 1.

Referring to FIG. 5, the front section 14 of the body 12 is threaded internally at 13 for a purpose to be described later. The middle section 16 of the body 12 is tubular in cross section and consists of an axial bore 28 and a wall 30. The wall 30, as best seen in FIG. 4, includes a cutout 32 consisting of a longitudinal slot 34, a retainer notch 36, and an arrangement of depth notches 38. The rear section 18 of the body 12 is formed of a generally cylindrical shape and, as shown in FIGS. 1, 2 and 5, a-handle 39 extends outwardly therefrom. The handle 39 has a plurality of flat surfaces 40 equally spaced radially for positive engagement with a three jaw chuck of a drill (not shown).

Referring again to FIG. 3, the drill bit 20, of conventional design for drilling masonry, concrete or the like, includes a smooth end 41 with a flat stepped portion 42 to be received into the bit holder 22. The bit holder 22 is cylindrical in shape with an outside diameter sized to allow the holder 22 to slide freely within the axial bore 28 of the body 12. The bit holder 22 is formed with a cavity 44 for receiving the smooth end 41 of the drill bit 20.

The cavity 44 has a sidewall 45 that closely encircles the smooth end 41 and prevents the bit from wobbling with respect to the bit holder 22. Adjacent the cavity 44 is an integral retainer collar 46 sized to fit within the rear end 27 of the coil spring 25 and serve as a seat therefor. Perpendicular to the cavity 44, and intersecting with it is a tapped hole 48 for receiving the set screw 23 for a purpose to be described later.

The driver attachment 24 is of a cylindrical shape with an externally threaded neck portion 52, which can be screwed into the body front section 14, and a head portion 54. Formed in the head portion 54 is a recessed hex drive socket 56 for receiving a standard screw driver bit 58, many shapes and sizes of which are readably available. Also formed in the driver attachment 24 is a throughbore 59 (shown only in FIG. 5) for passage of the drill bit 20. The throughbore 59 is smaller in diameter than the socket 56 so that the socket 56 and the throughbore 59 form a stairstepped configuration. The throughbore 59 is of a close enough fit to provide stability to the drill bit 20 when extended for drilling, and sufficiently long enough to ensure that the drill bit 20, when retracted, will have its front end located in the throughbore 59 but not contacting the end of screw driver bit 58 when seated in the socket 56.

The anchor set tool 10 is assembled by inserting the smooth end 41 of said drill bit 20 into the bit holder 22 so as to align the flat portion 42 directly under the tapped hole 48 (FIG. 5). Next, the coil spring 25 is slid over the drill bit 20 and is captured by the retaining collar 46 of the bit holder 22. This assembly is then slid into the bore 28 of the body 12 so that the tapped hole 48 is aligned with the longitudinal slot 34 of the cutout 32. The set screw 23 is then inserted through the slot 34, threaded into the tapped hole 48 and tightened down onto the flat portion 42 of the drill bit 20, thereby retaining the bit in the holder. Thus, the drill bit 20 and the bit holder 22 are slidably retained in the bore 28 of the body 12. Finally, the driver attachment 24 is screwed into the front section 14 of the body 12 to complete the assembly of the anchor set tool 10.

The rear end 27 of the coil spring 25 abuts against the bit holder 22 when the spring 25 is seated about the retainer collar 46. When the bit holder 22 is advanced forwardly in the axial bore 28 of the body 12, the front end 26 of the coil spring 25 comes into engagement with and abuts against the neck portion 52 of the driver attachment 24 causing the coil spring 25 to become compressed between the bit holder 22 and the neck portion 52. When compressed, the coil spring 25 acts as a bias means to urge the bit holder 22 and the drill bit 20 in a rearward direction within the axial bore 28. When the drill bit 20 is in the retracted position (FIG. 5), the coil spring 25 is relaxed and free from contact with the neck portion 52. It will be noted that while retracted, the point of the drill bit 20 is contained by the throughbore 59 of the driver means 24 but is sufficiently recessed so as to not come in contact with the rear of the screw driver bit 58.

When the screw driver bit 58 is not seated in the driver attachment 24, the bit 20 can be moved through the attachment 24 to project outwardly therefrom. This movement is accomplished by rotating the set screw 23 out from the retainer notch 36 and then moving the bit holder 22 in a linear fashion along the longitudinal slot 34 against the bias of the coil spring 26 and thereby extending the drill bit 20 past the head portion 54. The depth notches 38 can vary in quantity and location and are designed for alternatively receiving the set screw 38 so that the extension of the drill bit 20 can be varied to control the drilling depth to accommodate various lengths of anchor screws.

To improve the efficiency of the tool 10, the longitudinal slot 34 is adjoined by both the retainer notch 36 and the depth notches 38 through the use of rounded sidewalls. This allows the entire cutout 32 to be circumscribed by smooth, curved, and continuous front and rear sidewalls, 60 and 61 respectively (FIG. 4), that permit the set screw 23 to slide into and out of the depth notches 38. The rear sidewall 61 includes an entrance segment 62 that adjoins a rear part 63 of each depth notch 38 to the longitudinal slot 34 and follows the path of a semi-circle. The sidewall 61 also has a second semicircular medial segment 64. Finally, the rear sidewall 61 has an end segment 65 which is oppositely curved from that of segment 64 to allow the set screw 23 to slide into and out of an end portion 66 of each depth notch 38.

The front sidewall 60 follows a smooth arcuate path between a front part 67 and the end portion 66 of each depth notch 38. These rounded sidewalls allow the operator to use one uniform motion to slide the set screw 23 into and out of a desired depth notch 38 and thereby provide a means for efficient advancement and retraction of the drill bit 20. In a similar fashion, the retainer notch 36 has a curved retainer front wall 68 and a curved retainer rear wall 69 that allow the set screw 23 to move easily into and out of the retainer notch 36.

Once the operator has advanced the set screw 23 far enough into the desired depth notch 38, the arcuate rear sidewall 62 thereof allows the bias of the coil spring 25 to impel the set screw 23 into the end portion 66 of the selected depth notch 38. The bias of the coil spring 25 then serves as a temporary restrictive means to keep the set screw 23 in the end portion 66 of the selected depth notch 38 while the operator uses the tool to drill a desired hole.

After drilling of the hole is completed, the drill bit 20 is returned to its retracted position shown in FIGS. 1 and 5 and the screw driver bit 58 is inserted into the hex socket 56 of the driver attachment 24. As with throughbore 59 and its relationship with drill bit 20, the hex socket 56 is sized so as to minimize the wobbling of the screw driver bit 58 while driving an anchor screw, and such screw driver bit can be retained in hex socket by conventional means such as a locking ring, magnetism or friction fit.

Although the invention has been described with respect to a preferred embodiment thereof, it is to be understood that it is not to be so limited since changes and modifications can be made therein which are within the full intended scope of this invention as defined by the appended claims.

I claim:

1. An improved tool adapted for use with a hand drill for installing screw anchors in concrete or masonry walls or the like (a) a sleeve type body having:
  (1) an axial bore with a closed rear section and an open front section;
  (2) a longitudinally aligned open slot in said body;
  (3) at least one depth notch associated with the front portion of said slot;
  (4) a retainer notch associated with the rear section of said slot; and
  (5) an end portion contained within each depth notch.

(b) a handle extending outwardly from the rear end of said body and receivable in the chuck of said drill;

(c) a drill bit with a smooth end with a flat stepped portion;

(d) a bit holder slidably located in said bore and having an axial cavity and a set screw that extends from one side of said holder through the slot in said body and secures said smooth end in said cavity where a sidewall of said bit holder cavity closely encircles said smooth end;

(e) a driver attachment located at the front end of said body and having:

(1) a head portion with a socket; and (2) a neck portion positioned in the bore of said body and having a passageway that extends from the bottom of said head socket through said neck portion and opens to said body bore for closely encircling said bit to serve as a bit guide means;

a coil spring through which said bit extends and having a rear end that abuts against said bit holder and a front end that abuts against the neck portion of the said driver attachment, said spring being compressible between said bit holder and said driver attachment as said bit holder is advanced forwardly in the bore of said body into alignment with said depth notch, and said spring serving as a bias means to urge said bit and said bit holder in a rearward direction and to assist in positioning said set screw when received into said depth notch;

(g) means for securing said driver attachment to said body; and (h) said depth notch and retainer notch are formed to extend outwardly from said slot in an arcuate fashion so that said set screw slides into or out of said depth notch, and retainer notch with a uniform movement.

2. An improved tool as recited in claim 1 wherein said depth notch has rounded rear and front sidewalls so that it curves outwardly and rearwardly with respect to said slot.

3. An improved tool as recited in claim 1 wherein said retainer notch has a rounded retainer front wall and a rounded retainer rear wall so that it curves outwardly and frontwardly with repect to said slot.

4. An improved tool as recited in claim 2 wherein said rear sidewall comprises:

(a) a curved entrance segment opening into said slot;

(b) a curved medial segment; and (c) an end segment.

* * * * *